United States Patent [19]

Bacharach et al.

[11] Patent Number: 4,491,280

[45] Date of Patent: Jan. 1, 1985

[54] ROLLER MILL CONSTRUCTION

[75] Inventors: Ottmar Bacharach, Kaiserslatern; Herbert Schäfer, Vinningen, both of Fed. Rep. of Germany

[73] Assignee: Gebr. Pfeiffer AG, Kaiserslauter, Fed. Rep. of Germany

[21] Appl. No.: 479,957

[22] Filed: Mar. 29, 1983

[30] Foreign Application Priority Data

Apr. 5, 1982 [DE] Fed. Rep. of Germany ..... 3212724

[51] Int. Cl.[3] ..... B02C 15/00

[52] U.S. Cl. ..... 241/121; 241/285 R

[58] Field of Search ..... 241/117–122, 241/127, 128, 132, 133, 285 R, 287, 288, 289, 290, 114

[56] References Cited

U.S. PATENT DOCUMENTS

| | | | |
|---|---|---|---|
| 944,073 | 12/1909 | Callaway | 241/121 X |
| 1,520,319 | 12/1924 | Barthelmess | 241/122 |
| 1,648,176 | 11/1927 | Hanley, Jr. | 241/119 |
| 4,147,308 | 4/1979 | Mikkelsen | 241/117 |

FOREIGN PATENT DOCUMENTS

| | | | |
|---|---|---|---|
| 597878 | 6/1934 | Fed. Rep. of Germany | 241/122 |
| 771185 | 3/1957 | United Kingdom | 241/121 |
| 2042367 | 9/1980 | United Kingdom | 241/121 |

*Primary Examiner*—Mark Rosenbaum

*Attorney, Agent, or Firm*—Toren, McGeady and Stanger

[57] ABSTRACT

A roller mill having a grinding plate revolving around a vertical central axis and a plurality of grinding rollers arranged in grinding rolling contact with the grinding plate is constructed with a separate frame supporting each of the grinding rollers for rotation about a stationary axis, with each frame having projections at both its ends constructed to form a connecting joint between the frames at each of the ends thereof.

6 Claims, 8 Drawing Figures

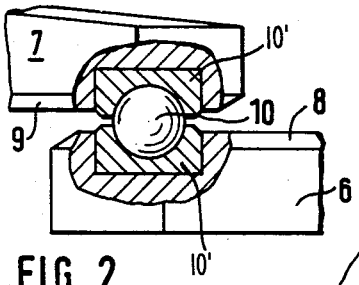
FIG. 2
FIG. 6
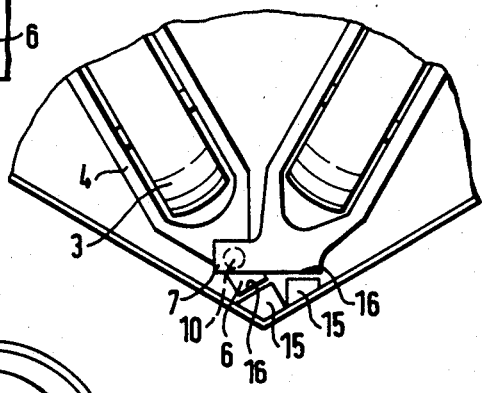
FIG. 4
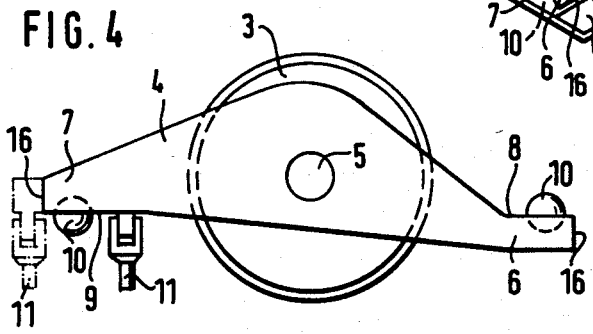
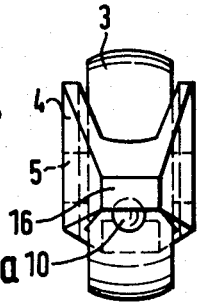
FIG.4a
FIG. 5
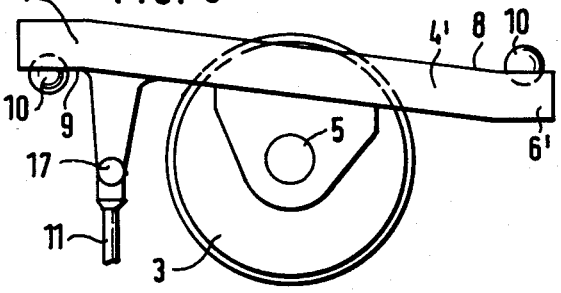
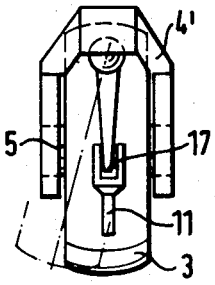
FIG.5a

ROLLER MILL CONSTRUCTION

The present invention relates to the construction of a rolling mill and more particularly to a rolling mill of the type for crushing minerals such as rock, coal, ore and the like.

Known roller mills of the type to which the present invention relates are equipped with a grinding plate which revolves around a vertical central axis. A plurality of grinding rollers are arranged for rotation about stationary axes in rolling engagement with the grinding plate. In the prior art devices, grinding rollers are under contact pressure which may, for example, be applied by means of a press frame arranged over the grinding rollers. Usually, the grinding rollers are suspended from the press frame so as to swivel around a swiveling axis. Connecting or tie rods in turn which extend to the milling frame foundation engage the press frame.

The press frame and other milling parts approximately comparable therewith in construction and effect substantially increase not only the weight but also the structual height of the particular mill.

In the type of suspension of grinding rollers described, the grinding and definition (limit) respectively of the possible pendulation of the grinding rollers is effected by means of the grinding bed on the grinding plate. For this reason, the grinding plate is formed with a corresponding shape.

Other mills are known wherein three rollers are supported at a triangular holding body in various forms but always basically with the same structure with the triangular holding body being located in a space between the rollers which are again arranged so as to revolve around stationary axes. In this device there is no pendulation of the rollers. However, the entire arrangement which is rigid in itself produces the result that when the position of a roller is changed, for example because of a foreign body in the grinding material, at least the position of adjacent rollers will be impaired. Thus, in arrangements wherein three rollers are provided, the entire roller arrangement may be influenced. However, such circumstances must be absolutely avoided since they tend to impair the grinding process and effect additional loads or stresses on the bearings and structural components of the mechanism.

Accordingly, the present invention is directed toward a development in roller mill design such that the grinding rollers will be guided in a manner which is independent of the grinding bed and which allows mobility to be adjusted in a controlled way with respective requirements of the milling process without the rollers reciprocally impairing each other's operation and thus the grinding process. Moreover, the invention seeks to achieve a distinct reduction in the structural volume and weight of the mill by means of the inventive roller guidance technique.

SUMMARY OF THE INVENTION

Briefly, the present invention may be described as a roller mill comprising a grinding plate revolving around a vertical central axis, a plurality of grinding rollers in rolling grinding contact with said grinding plate, a roller frame supporting each of said grinding rollers for rotation about a stationary axis in grinding engagement with said grinding plate, with each of said rollers being individually supported on a separate roller frame, said roller frame comprising projections at both ends thereof constructed to form a connecting joint between said frames and means between adjacent projections for forming a connecting joint between said frames.

Thus, the objects of the invention are achieved in that the grinding plate is arranged to revolve around a vertical axis with the plurality of grinding rollers rolling on the grinding plate. The grinding roller arrangement with the production of grinding pressure between the grinding rollers and the grinding plate, is housed and supported in the mill housing in such a way that each grinding roller is supported in its own frame, the frames having projections or shoulders for receiving a flexible or articulated connection with the projections of the frame of adjacent rollers so that a closed grinding roller arrangement is effected.

Thus, the invention achieves the result that each of the grinding rollers follows the grinding plate even when obstacles develop without the course of movement of adjacent rollers being influenced.

Conventional means can be provided for supporting and guiding the grinding roller arrangement with the roller frames. Since a press frame common to all the rollers is no longer utilized over the rollers, the mill may be constructed so as to be lower and lighter in weight. Nevertheless, the grinding roller arrangement is not rigid and there is avoided the disadvantage of the mutual influence normally associated with such rigidity. Since the grinding rollers no longer require that they be guided by means of the grinding bed, the bed may be constructed with a flatter configuration.

It is advantageous to provide connecting rods for supporting and guiding the grinding roller arrangement and for applying the grinding pressure and also to provide the connection point for these connecting rods at the roller frame beneath the plane of the joint midpoint so that forces occurring when there is unevenness in the grinding track will produce restoring forces for the most rapid possible return of the grinding rollers into their normal position.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings:

FIG. 2 is a sectional view partially broken away showing a connecting joint or hinge point between two adjacent roller frames depicted on an enlarged scale;

FIG. 4 is a side view of a roller frame;

FIG. 4*a* is a front view of a roller frame;

FIG. 5 is a side view of another embodiment of the roller frame;

FIG. 5*a* is a front view of the roller frame of FIG. 5; and

FIG. 6 shows a further embodiment of the invention wherein the roller frame has an angled configuration.

DETAILED DESCRIPTION OF THE PREFERRED EMBODIMENTS

Figure 1:
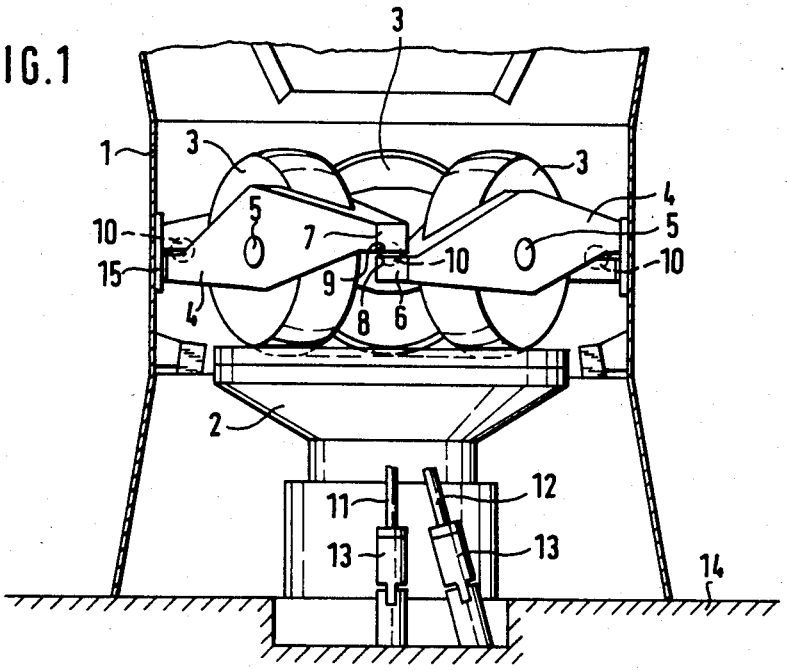
FIG. 1 is a side view showing a mill in accordance with the present invention.
Figure 3:
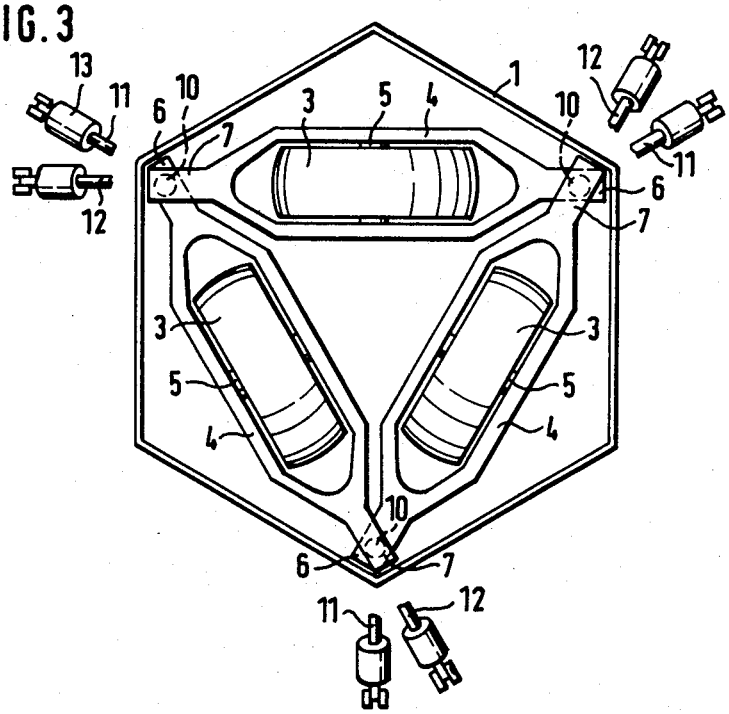
FIG. 3 is a top view of the mill of FIG. 1.

Referring now to the drawings, there is shown a mill apparatus wherein the present invention is embodied which comprises a mill housing 1 having an upper area which receives a separator or sifter with a grinding plate 2 being arranged to be driven so as to revolve around its vertical central axis. The mill depicted in the drawings comprises three rollers 3 which are arranged to roll on the grinding plate 2 and which are supported in identically constructed roller frames 4 so that the rollers 3 will revolve around an axis 5. The grinding roller frames 4 are formed with projections 6 and 7 on the front side thereof.

The projection 6 of a roller frame extends, for example, beneath a plane within which there lies the axis of rotation 5 of each of the individual rollers 3 and the projection 6 is formed with an upper surface 8 which lies within the same plane as the axes 5. The projections 7 are also formed for example with a lower surface 9 and extend about this plane.

The projections 6 and 7 are constructed for example as pans 10' for a ball 10 arranged therebetween. However, the height or level of a joint formed by the projections 7 and the balls 10 may lie above or beneath the grinding roller center.

In contrast to known mills, the press frame over the rollers first of all is thus dispensed with which directly results in a corresponding reduction in the structural height of the mill. The grinding roller arrangement and the necessary means for producing pressure and for guiding the rollers are also substantially lighter than in previous devices. The three grinding rollers are completely independent from one another and it should be understood of course that a different number of grinding rollers may also be provided. The roller frames form an isosceles triangle with the corners of the triangle being located at the position of the projections 6 and 7 which together with the balls 10 form connecting joints in the form of ball sockets between the frames 4. Thus, each roller may follow the grinding bed in as advantageous a manner as possible and changes in height which would be developed due to obstacles on the grinding bed will not cause an influence on the course of movement of the adjacent rollers since the rollers may move independently and not with a mutually rigid roller arrangement.

The arrangement formed by means of the three roller frames 4 may be supported and guided in the mill housing 1 in a manner that may be conventional in the art. Thus, connecting rods 11 and 12 may be provided and they may be supported in a mill foundation 14 with the intermediary of hydraulic cylinders 13 and they may engage at the corner points of the triangle formed by means of the roller frames. Moveover, slide and impact plates may be provided in the mill housing at the corner point areas of the triangle formed by means of the roller frames, at which slide and impact plates 15 the roller frames may be supported with their front sides 16.

The connecting rods 11 and 12, respectively, may engage in the area of the lower surface 9 of the roller frame 4 to the right or to the left of the connecting joint or at the centerpoint of the joint itself, as shown in FIG. 4.

In the arrangement shown in FIGS. 5 and 5*a*, if the connecting point 17 is arranged as low as possible beneath the grinding roller axis 5, but particularly beneath the ball 10, restoring forces result in obstacles occurring in the grinding track, which restoring forces make a deflection or yielding more difficult and effect a return of the grinding rollers 3 into the stable position on their grinding track radius. Thus, the embodiment of the roller frames is different from the previously described forms. In place of the projections 6 and 7, a variation form 6' and 7' is provided at a roller frame 4'.

In an embodiment shown in FIG. 6, at least one of the projections 6 and 7 may be bent inwardly or formed with an offset or angular configuration extending inwardly relative to the vertical central axis of the mill so that the connecting joints formed by means of the projections 6 and 7 and the balls 10 will extend radially inwardly so that the space requirement in the horizontal direction may be reduced.

It will thus be seen in accordance with the present invention that there is provided a distinct improvement over known roller mills having grinding plates which revolve around a central vertical axis with rollers rolling on the grinding plate and rotating around stationary axes while under contact pressure with the grinding plate. In accordance with the invention, to achieve a running of the grinding rollers which is independent particularly of the grinding bed and to support each of the grinding rollers individually in roller frames assigned thereto in order to reduce the structural height and weight of the mill, the roller frames are formed with projections at both ends which are movably connected with the projections of the other roller frames. In such a way, the roller frames may be joined together with the rollers with the intermediary of a connecting or articulated joint in each case so that there is formed a corresponding grinding roller arrangement. Here, each grinding roller may follow the grinding plate even during the occurrence of obstacles without the movement course of the adjacent rollers being impaired. The reduction of the structural height is achieved by means of omitting the known press frame arranged above the rollers.

While specific embodiments of the invention have been shown and described in detail to illustrate the application of the inventive principles, it will be understood that the invention may be embodied otherwise without departing from such principles.

What is claimed is:

1. A roller mill comprising:

a grinding plate revolving around a vertical central axis;

a plurality of grinding rollers in rolling grinding contact with said grinding plate;

a roller frame supporting each of said grinding rollers for rotation about a stationary axis in grinding engagement with said grinding plate, with each of said rollers being individually supported on a separate one of said roller frames;

said roller frames comprising projections at both ends thereof constructed to form a connecting joint between adjacent ones of said roller frames and means between adjacent projections for forming a connecting joint between said frames, said connecting joint being structured to enable articulated movement between said roller frames; and means for generating a grinding pressure at said roller frames, said means for generating being engaged with said roller frames in the area of said joints.

2. A roller mill according to claim 1, wherein said means for generating comprise connecting rods for supporting and guiding said grinding rollers.

3. A roller mill according to claim 2, wherein said connecting rods engage said roller frames from the underside thereof.

4. A roller mill according to claim 3, wherein said connecting rods are connected with said roller frames at connecting points which are provided as low as possible beneath the said stationary axis and said connecting joint.

5. A roller mill according to claim 1, wherein said connecting joints are constructed to comprise a ball and a pair of pans on either side thereof.

6. A grinding roller according to claim 1, wherein at least one of said projections is bent in such a manner that said connecting joint will move radially toward said central axis.

* * * * *